United States Patent [19]

Lorenz

[11] 4,038,561

[45] July 26, 1977

[54] CHILDREN'S LAMP

[76] Inventor: Michael Lorenz, 421 55th St., Downers Grove, Ill. 60515

[21] Appl. No.: 591,456

[22] Filed: June 30, 1975

[51] Int. Cl.[2] ..... H01H 43/00

[52] U.S. Cl. ..... 307/141; 58/21.12

[58] Field of Search ..... 307/149, 141, 141.4, 307/141.8; 240/2 L; 200/38 FA; 58/21.12, 21, 155; 179/100.1 C; 340/335, 328, 309.1; 315/DIG. 4

[56] References Cited

U.S. PATENT DOCUMENTS

| | | | |
|---|---|---|---|
| 2,512,775 | 6/1950 | Patissi | 340/309.1 |
| 2,907,901 | 10/1959 | Parker | 307/141 |
| 3,727,395 | 4/1973 | Baylor | 58/21.12 |
| 3,798,889 | 3/1974 | Chadwick | 58/21.12 |
| 3,931,621 | 6/1976 | Rose | 340/328 |
| Re. 26,119 | 12/1966 | Slater | 315/100 D |

*Primary Examiner*—Robert K. Schaefer
*Assistant Examiner*—Morris Ginsburg
*Attorney, Agent, or Firm*—McWilliams & Mann

[57] ABSTRACT

A lamp and tape deck for a childs room which includes a timer mechanism that may activate either the lamp or the tape deck, or both, for any predetermined time period and which may automatically and gradually diminish the light level and gradually reduce the volume of the tape deck or conversely increase the light level and the volume over a similar time span and wherein the lamp and tape deck can be operated independently of each other and either the lamp or the tape deck can be operated independently of the timer mechanism.

1 Claim, 1 Drawing Figure

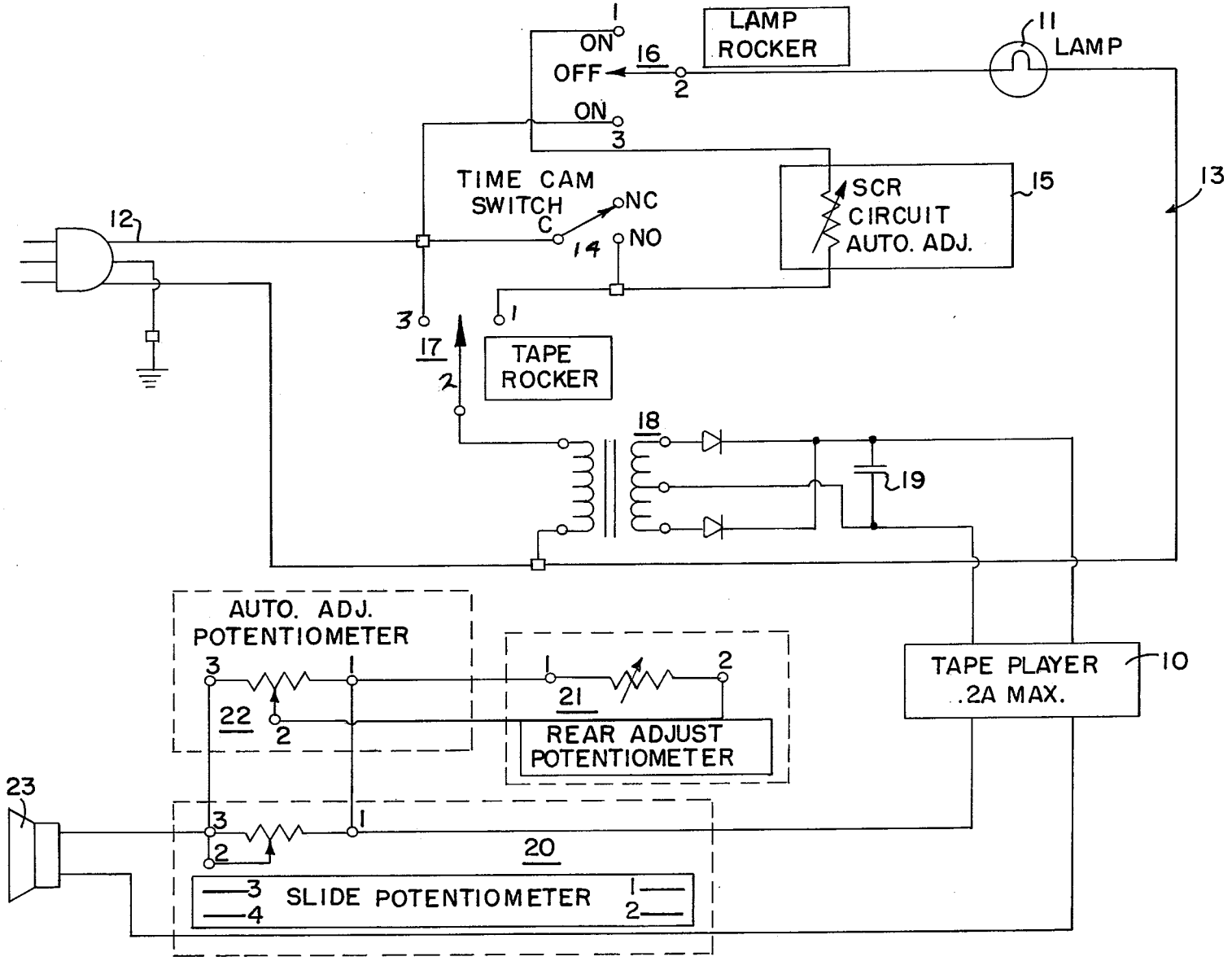
13
LAMP
11
LAMP ROCKER
16
ON
OFF
ON
1
2
3
15
SCR CIRCUIT AUTO. ADJ.
TIME CAM SWITCH
NC
NO
C
14
TAPE ROCKER
17
1
2
3
12
18
19
TAPE PLAYER .2A MAX.
10
REAR ADJUST POTENTIOMETER
21
AUTO. ADJ. POTENTIOMETER
22
SLIDE POTENTIOMETER
20
23

CHILDREN'S LAMP

BACKGROUND OF THE INVENTION

The prior patent art reveals various clock radios incorporating timing mechanisms or devices to turn the radio on or off at a set time or actuate an alarm. Certain such prior art radios included a light adapted to be flashed on and off as a signal to awaken a sleeping person. Other such radios incorporated a so-called "slumber-switch" used to turn the radio on and after expiration of a selected time period when the user has gone to sleep to turn the radio off. This slumber switch was such that it could be utilized without affecting the alarm setting for the radio. It was known too in clock radios that two sets of volume and station selecting controls might be utilized so that when a timer mechanism activated the radio it would operate at a preselected station and volume which operation could be had independently of a separate set of tuning and volume controls. One prior clock radio provided timer mechanism which activated the radio for a period of time and over this period of time uniformly decreased the volume of the radio from its set position, or volume level, to zero, after which the radio was turned off. When the radio was automatically turned on again as a wake up device, the mechanism caused the volume gradually to increase from the zero position, or level, to its previous setting.

Another prior patent disclosure reveals a light alarm system associated with an electrical clock so that the light was activated at a preset time as a wake up alarm controlled by the clock mechanism. When activated the light operated at a low light level and gradually increased from this minimum degree of brightness until full brightness was attained in simulation of daylight.

SUMMARY OF THE INVENTION

The present invention combines a timing mechanism with a tape deck and a light whereby the volume of the tape deck and the light level projected by the light may be controlled automatically to vary the light level simultaneously with the volume output of the tape deck over a predetermined period of time. The light level and the volume may be preset to diminish simultaneously or conversely to increase the light level and volume together, or the light and tape deck can be activated independently of each other and either can be operated independently of the timer mechanism. The invention controls the lamp brightness in accordance with preselected conditions and automatically or manually, controls the output volume of the tape deck while affording the playing of preselected music at the choice of the listener. The invention may be utilized as a continuous tape player with manual volume control, or it may be used as a night light, or the like, if desired. However, timing mechanism used with the light and tape deck enable the light to be set for automatic operation for any period of time within the capacity of the timer and similarly the tape deck may be preset for any such period of automatic operation. The arrangement regulates light brightness automatically in accordance with preset controls and automatically or manually regulates the volume of an audio source also in accordance with preset controls.

OBJECTS OF THE INVENTION

It is the primary purpose of this invention to provide controlled light and music in a childs room during those periods when the child has retired for a nights sleep or when it is time to awaken to a new days activities.

The principal object of the invention is the provision of a light source and an audio source with a timing mechanism to activate the light source and the audio source and regulate the brightness of the light and the volume output of the audio source over a period of time determined by the timing mechanism.

An important object of the invention is to provide a light source and an audio source in combination with a timing mechanism and controls to regulate the brightness of the light source and the volume output of the audio source to gradually diminish the amount of light and gradually reduce the volume output of the audio source over a period of time determined by the timing mechanism.

A further and important object of the invention is the provision of a light source and an audio source under the control of an automatic timing mechanism to gradually dimish the brightness of the light source and simultaneously reduce the volume output gradually of the audio source over a preset period of time and deactivate both sources.

DESCRIPTION OF THE DRAWINGS

The foregoing and other more important objects of the invention are attained by the mechanism and arrangement illustrated in the accompanying drawings, wherein FIG. 1 is a general schematic diagram of an arrangement of this invention including an audio source in the form of a tape deck, a light source represented by a lamp and automatic timing mechanism with an SCR circuit to adjust the brightness of the lamp and volume of the audio, a step down transformer and series-parallel dual potentiometer in the circuit in conjunction with a series variable resistor and a speaker projecting sound from the tape deck.

DESCRIPTION OF PREFERRED EMBODIMENT

As shown in the drawing an audio source in the form of a tape player 10 and a light source in the form of a lamp 11 are provided in a schematically illustrated circuit arrangement generally indicated at 13 and including a three conductor line cord 12 adapted to be plugged into a suitable source of power to energize the circuit. The arrangement is such that the light and tape player can be operated automatically or the tape player might be used as a continuous source of music with manual volume control while the lamp might be utilized as a separately controlled night light or the tape player and light might be used in any combination operating arrangement desired. The tape player may be played continuously with the manual operation while the light might be operated automatically or the player might be operated automatically while the light is activated manually and of course, both can be operated either automatically or manually.

The timing mechanism 14, as shown, comprises a sixty minute timer which can be set for any time period between zero and sixty minutes and normally is adjusted by merely rotating the indicator to the point necessary to provide the desired period of operation. By this means the lamp 11 as well as the tape player 10 can be set for any period of operation within the capacity of the timer and dependent only upon the degree to which the timer indicator is rotated. The timing mechanism 14 functions through an automatic adjusting SCR circuit device 15 to adjust the brightness of the lamp 11 through the rocker switch device 16 regardless of whether it is set to increase the brightness or set to keep brightness constant dependent upon how the rocker switch 16 is set. When the timer indicator of the timing mechanism 14 is turned fully clockwise the lamp 11 will be at its brightest and as the indicator moves counterclockwise to return to its starting position the brightness of the lamp will be diminished. In position 1 of the rocker switch 16 the lamp 11 is caused to operate in the timed mode while in position 3 of the switch 16 the lamp is caused to operate in a continuous full on mode.

The brightness of the lamp under control of the timer 14 through the SCR device 15 will be proportional to the position occupied by the timer indicator as it returns to the start position. For instance if the indicator shows thirty minutes remaining on a one hour timer then the lamp 11 will be at medium brightness representing half of the return movement of the indicator to the start position. However, the lamp 11 may be switched to its fullest brightness if desired though the timer 14 may still be operating. This may be accomplished through switch 16 in position 3. Also the lamp 11 can be turned off when the timing mechanism 14 is operating if for any reason this is indicated and this is accomplished by means of rocker switch 16 in position 2.

The SCR device 15 controls the light level of the lamp 11 and operates in conjunction with the timing mechanism 14 and when the timer 14 is in its normal position the circuit of the SCR device is in its state of lowest lamp brightness or what might be called the maximum dimness of the light 11. When the timer 14 is in its normal off position the circuit of the SCR device is in its state of maximum brightness of the lamp 11.

A step-down transformer 18 is provided in the circuit 13 and a capacitor 19 is provided across the circuit leading to the tape player 10.

The tape player, of course, can also be programmed to be operated under the control of the timing mechanism 14. Like the lamp 11 the tape player can be set to play automatically for any period of time desired within the capacity of the zero to sixty minutes timer mechanism 14. The tape player 10 will be turned on when the indicator of the timer is rotated clockwise from its normal, or starting position and depending upon the period of time selected, will play for that time and then will be turned off when the indicator of the timer mechanism 14 reaches its original start position upon its return movement.

Speaker 23 projects the sound generated by the tape deck 10. The volume output of the tape player is proportional to the position of the timer indicator and as an example, when the indicator shows thirty minutes remaining on the one hour timer the output of the tape player will be at half volume. The tape player 10 can be adjusted to its full volume if desired, even though the timing mechanism 14 is still operating and like the lamp 11 this is accomplished through adjustment of the rear adjustment or slide potentiometers 21 or 20. If for any reason it may be desired to turn the tape player off while the timer mechanism continues to operate this may be done by means of the rocker switch 17.

In position 1 of the rocker switch 17 the tape player 10 is caused to operate in the timed mode while in position 3 of this rocker switch the tape player is caused to operate continuously and position 2 of the switch represents the off position. The volume of the tape player, of course, is regulated by the potentiometer mechanism, as hereinafter described, and can be adjusted while the timing mechanism 14 is operating.

The preselected volume level of the tape player 10 may be set anywhere from minimum to maximum levels when the desired time of operation is set on the timer mechanism 14 and when the rocker switch 17 is set for a decreasing volume, the playing volume output of the tape deck 10 wll gradually decrease proportionally to the time span for which it is set, until it reaches its lowest volume output and then will be turned off. The gradual reduction in volume output is accomplished through a series-parallel dual potentiometer circuit including an adjustable potentiometer 21 and an automatic adjusting potentiometer 22 which operate in conjunction with a series variable resistor comprised of a potentiometer 21. The tape player as referred to hereinbefore may be operated and the volume output thereof may be adjusted independently of the timer mechanism 14 and the player can be switched off irrespective of the position of the indicator on the timing mechanism. The tape deck 10 is indicated diagrammatically in the drawing but might be reel-to reel type, or comprise a cartridge or casette type player.

The rocker switches 16 and 17 as shown comprise single pole, double throw switches which provide for normal operation of the light 11, or the tape deck 10 whereby the volume output of the tape deck might be gradually reduced while the brightness of the light would remain constant, or the brightness of the light be gradually diminished while the volume output of the tape deck would remain constant. Both the brightness of the light 11 and the volume output of the tape deck 10, of course, can be reduced or increased simultaneously and either can be varied individually while the other is turned off.

The lamp 11 and the tape deck 10 are mounted individually and may be connected with the timing mechanism 14 through suitable gear arrangements, not shown. Such gear mechanism is operated only by the timer 14 and may be such as to actuate the light 11 and the tape deck 10 to diminish the brightness of the light and reduce the volume output of the tape deck simultaneously or to increase the brightness of the light and the volume output of the tape deck depending upon the direction in which gears of potentiometer and dimmer are mounted.

SUMMARY

The rocker switch 16 regulates and controls the operation of lamp 11. When this switch is in position 3 it controls the full brightness operation of the lamp even when the timer 14 is operating and when the switch is in position 2 the lamp 11 is turned off even though the timer 14 may be operating. When the rocker switch 16 is placed in position 1 where it is operative in conjunction with the timing mechanism 14 and the SCR device 15 the lamp 11 turns off, of course, when the timer 14 reaches its normal off position.

The rocker switch 17 controls the continuous operation of the tape player 10 but the volume of the player can be adjusted manually by means of the slide potentiometer 20. In the off position 2 of the rocker switch 17 the tape player is turned off even though the timer 14 may be operating. In position 1 of this rocker switch the tape player 10 is operated in the timed mode and in conjunction with the timing mechanism 14 and the automatic potentiometer 22 and rotary potentiometer 21 but the volume can be adjusted in this timed position as described hereinbefore. In the timed mode of operation the volume of the tape player decreases as the timer 14 returns toward its normal position 2 and when the timer reaches this off position the tape player, of course, is turned off.

The timing mechanism 14 operates the SCR circuit device 15 and the automatic potentiometer 22 and rotary potentiometer 21 and the normal position of the timer represents the low position of the SCR circuit and the rotary potentiometer while the full off position of the timer represents the full on position of the SCR circuit and the rotary potentiometer.

From the foregoing it will be seen that there has been provided a combination tape deck, light and timing mechanism therefor which is particularly adapted to be used in a childs bedroom and which upon activation by the timing mechanism will gradually diminish the brightness of the light over a preset period of time determined by the timing mechanism while simultaneously gradually reducing the volume output of the tape player and both the light and tape player will be deactivated at the completion of the selected time period. Further, the invention contemplates that the light and the tape deck may be activated each to operate independently and that both the tape deck as well as the light may be operated independently of the timer mechanism.

What is claimed is:

1. A combination audio, light and timing mechanism adapted to provide light and sound under control of said timing mechanism including an electrical circuit for the light and an audio device and a source of power energizing the circuit, an automatic adjusting SCR circuit device in said electrical circuit, a pair of rocker switches disposed in circuit with said timing mechanism and said SCR circuit device each comprising a single pole double throw switch, potentiometer means in the electrical circuit including an automatic adjusting potentiometer and an adjustable potentiometer operating in circuit with a variable slide potentiometer with the automatic adjusting potentiometer and the adjustable potentiometer disposed in series parallel to provide a dual potentiometer circuit, a step-down transformer in the electrical circuit, and speaker means projecting said sound, said potentiometer means being disposed in the electrical circuit between said audio device and said speaker means.

* * * * *